US009196200B2

(12) United States Patent
Chien

(10) Patent No.: US 9,196,200 B2
(45) Date of Patent: Nov. 24, 2015

(54) METHOD OF ESTABLISHING LOOK-UP TABLE FOR ELECTROPHORETIC DISPLAY AND DEVICE THEREOF

(75) Inventor: Chun Ta Chien, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 391 days.

(21) Appl. No.: 13/597,370

(22) Filed: Aug. 29, 2012

(65) Prior Publication Data

US 2013/0120333 A1 May 16, 2013

(30) Foreign Application Priority Data

Nov. 16, 2011 (TW) ..... 100141837 A

(51) Int. Cl.
*G09G 3/34* (2006.01)

(52) U.S. Cl.
CPC ..... *G09G 3/344* (2013.01); *G09G 2310/06* (2013.01); *G09G 2330/021* (2013.01)

(58) Field of Classification Search
CPC ..... G09G 3/344
USPC ..... 345/208, 107
See application file for complete search history.

(56) References Cited

U.S. PATENT DOCUMENTS 4,247,817 A * 1/1981 Heller ..... 327/63
7,834,839 B2 * 11/2010 Muto et al. ..... 345/101
8,593,396 B2 * 11/2013 Amundson et al. ..... 345/107
2005/0024353 A1 * 2/2005 Amundson et al. ..... 345/204
2006/0119567 A1 * 6/2006 Zhou et al. ..... 345/107
2011/0096104 A1 * 4/2011 Sprague et al. ..... 345/690
2011/0267332 A1 * 11/2011 Yamazaki ..... 345/211

FOREIGN PATENT DOCUMENTS

TW 200627207 8/2006

OTHER PUBLICATIONS

"Office Action of Taiwan Counterpart Application", issued on Jul. 31, 2014, p. 1-p. 7.

* cited by examiner

*Primary Examiner* — Kent Chang
*Assistant Examiner* — Scott Au
(74) *Attorney, Agent, or Firm* — Jianq Chyun IP Office

(57) ABSTRACT

A method of establishing a look-up table for an electrophoretic display is disclosed. The method is for establishing a plurality of driving waveforms of the electrophoretic display to the look-up table. The method includes dividing the plurality of driving waveforms to a plurality of time intervals according to a plurality of voltage values of the plurality of driving waveforms. The method also includes preparing a plurality of voltage waveform records according to the plurality of the voltage values and numbers of a unit times of the corresponding time intervals, and storing the plurality of voltage waveform records into the look-up table. Therefore, the storing capacity occupied by the look-up table of the electrophoretic display may be saved.

12 Claims, 4 Drawing Sheets

METHOD OF ESTABLISHING LOOK-UP TABLE FOR ELECTROPHORETIC DISPLAY AND DEVICE THEREOF

BACKGROUND OF THE INVENTION

1. Field of the Invention

The instant disclosure relates to an electrophoretic display; in particular, to a method of establishing look-up table for an electrophoretic display and device.

2. Description of Related Art

The invention of cathode-ray tube starts the progress of display device. However, the cathode-ray tube is gradually replaced by the liquid-crystal display, the light-emitting diode display, or the plasma display, because the cathode-ray tube has a huge size and has larger power consumption. The cathode-ray tube, the light-emitting diode display, and the plasma display are self-light emitting displays, and the self-light emitting displays consume more electrical power for operation. The liquid-crystal display is a see-through display, and alignment of the liquid-crystals in the liquid-crystal display can be controlled by driving voltages. The liquid-crystal display can display images by controlling whether a light source of the liquid-crystal display penetrates the liquid-crystals.

Comparing to the self-light emitting display and liquid-crystal display, a reflective display reflects ambient light for display images. Therefore, the reflective display saves more electrical power. Currently, the electrophoretic display is a well-developed reflective display. The electrophoretic display usually has microcapsules, and the microcapsules can be controlled by driving voltage generated by driving circuit in order to make the electrophoretic display show images.

However, the driving waveforms generated by the driving circuit usually have the capability of maintaining the stability and the clarity of images, and the driving waveforms have to clear the previous image and adjust the refresh rate. Therefore, the driving waveforms are usually stored in a predetermined look-up table. The look-up table of driving waveforms is usually complex, and a large storage capacity may be needed to store the look-up table.

Traditionally, driving waveforms are divided by a predetermined unit time (e.g. 20 millisecond), and voltage values of waveform in each unit time is stored in the look-up table in time sequence. Then, a clock-controlled circuit reads the voltage values stored in the look-up table in time sequence, and the driving circuit can generate driving waveforms according to the voltage values from the look-up table.

Considering the display performance, a driving waveform usually includes some shaking pulses, reset pulses, and driving pulses. The shaking pulses are used to decrease the inertness of microcapsules. The reset pulses are used to increase the reproduction rate of the optical state for the pixel represented by microcapsules. The driving pulses can be a voltage with zero amplitude. However, when the pixels of the electrophoretic display or the colors displayed by the electrophoretic display are smaller in certain applications, a traditional look-up table may occupy unnecessary storage capacity or just complicate the design of the electrophoretic display.

SUMMARY OF THE INVENTION

The object of the instant disclosure is to provide a method of establishing a look-up table for an electrophoretic display and device thereof.

According to an embodiment of the instant disclosure, a method of establishing a look-up table for an electrophoretic display is offered. The method is for establishing a plurality of driving waveforms of the electrophoretic display to the look-up table. The method includes dividing the plurality of driving waveforms to a plurality of time intervals according to a plurality of voltage values of the plurality of driving waveforms, obtaining a plurality of voltage waveform records according to the plurality of voltage values and the number of the unit time of the corresponding time intervals, and storing the plurality of voltage waveform records into the look-up table.

An electrophoretic display device adopting the aforementioned method is also provided. The electrophoretic display device includes an electrophoretic screen, a driving circuit, and a memorizing module. The driving circuit is electrically coupled to the electrophoretic screen, and the driving circuit drives the electrophoretic screen according a plurality of driving waveforms. The memorizing module has a look-up table and stores the plurality of driving waveforms for driving the electrophoretic screen. The plurality of driving waveforms is divided to a plurality of time intervals. The plurality of driving waveforms is divided at the change point of the voltage value changed over time for making the voltage value at each time interval be constant. A plurality of voltage waveform records is obtained according to the plurality of voltage values and a number of unit times of the corresponding time intervals. The plurality of voltage waveform records is stored into the look-up table.

In summary, the method of establishing a look-up table for an electrophoretic display and device thereof offered by embodiments of the instant disclosure can reduce the size of the look-up table. Furthermore, when the electrophoretic display is smaller in size or the resolution of the electrophoretic display is less demanding, the driving waveforms can be simplified because the requirement of display performance is lower. Therefore, the storing capacity occupied by the look-up table of the electrophoretic display may be saved.

In order to further the understanding regarding the instant disclosure, the following embodiments are provided along with illustrations to facilitate the disclosure of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

[An Embodiment Of A Method Of Establishing A Look-Up Table For An Electrophoretic Display]

Figure 1:
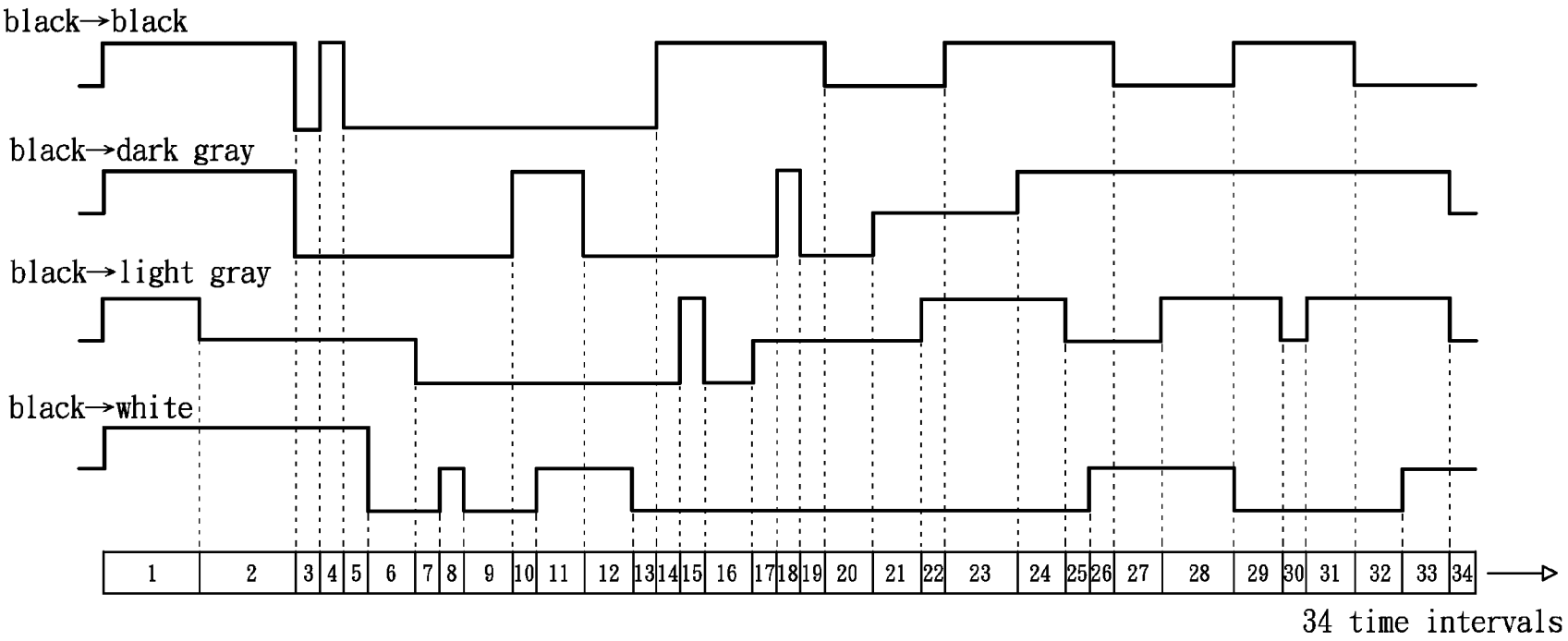
FIG. 1 PRIOR ART
FIG. 1 shows a curve diagram of driving waveforms of a traditional electrophoretic display.

Please refer to FIG. 1. FIG. 1 shows a waveform diagram of driving waveforms of a traditional electrophoretic display. In this embodiment, for explaining the method, the driving waveforms shown in FIG. 1 are for the electrophoretic display that can show four colors (or gray levels), such as black, dark gray, light gray, and white. In order to show these four gray levels and variations among them, there should be at most sixteen driving waveforms. As shown in FIG. 1, these driving waveforms at least includes four waveforms illustrating changes in the gray level, such as black to black, black to dark gray, black to light gray, and black to white. These mentioned four waveforms are exemplary for explanation, and other waveforms are not shown in FIG. 1. The driving waveforms are usually voltage waveforms ranging from +15 volts and −15 volts in one implementation. And it is worth noting that the absolute value of the difference between a high voltage (e.g., +15 volts) and a low voltage (e.g., −15 volts) usually hinges on the structure of the microcapsules and the geometric structure of the electrophoretic display.

Figure 2:
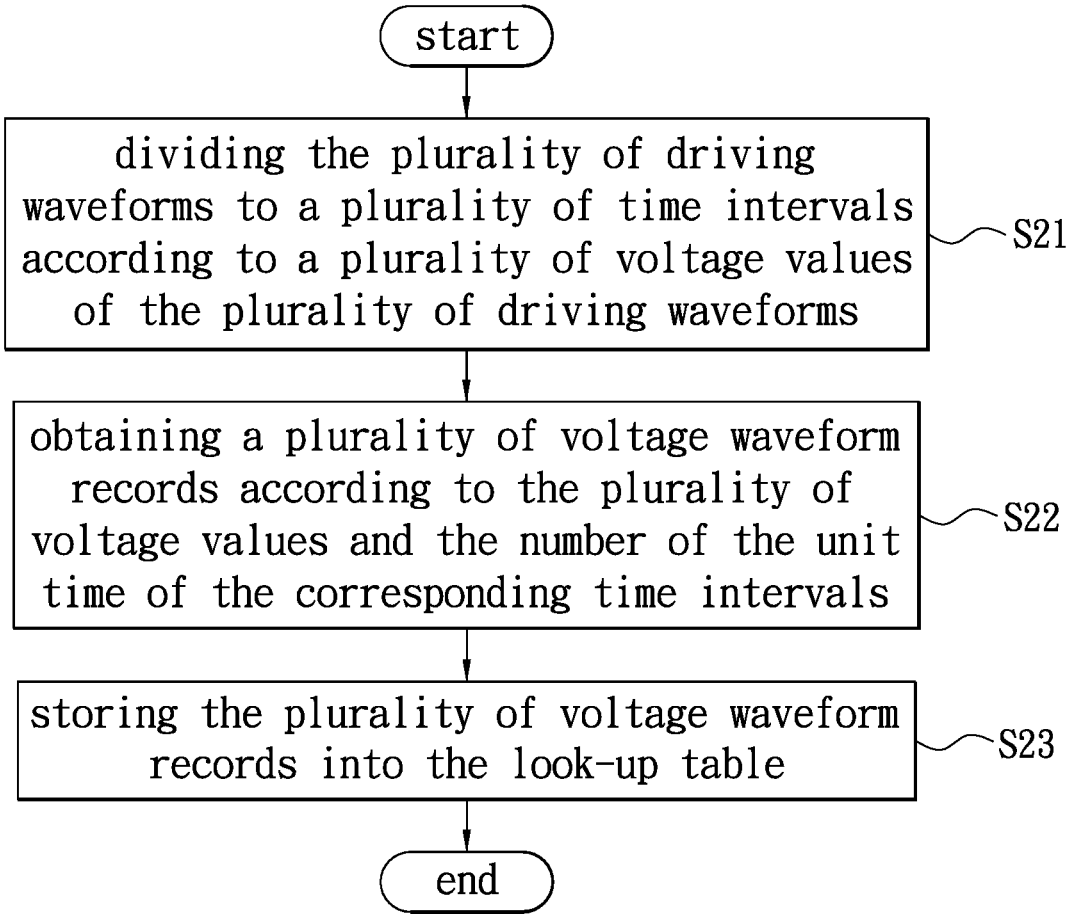
FIG. 2 shows a flow diagram of a method of establishing a look-up table for an electrophoretic display according to an embodiment of the instant disclosure.

Please refer to FIG. 2. FIG. 2 shows a flow chart of a method of establishing a look-up table for an electrophoretic display according to an embodiment of the instant disclosure. In step S21, the method includes dividing the plurality of driving waveforms to a plurality of time intervals according to a plurality of voltage values of the plurality of driving waveforms. A length of each time interval is multiple times of the unit time. In step S22, obtaining a plurality of voltage waveform records according to the plurality of voltage values and the number of the unit time of the corresponding time intervals, wherein each voltage waveform record includes the number of the unit time corresponding to each of the time intervals and voltage values corresponding to each of the time intervals. In step S23, the method may further include storing the plurality of voltage waveform records into the look-up table in time sequence.

Traditionally, the unit time of the driving waveform stored in the look-up table is predetermined, and the traditional unit time is unchanged and independent of the variation in the voltage value of the driving waveforms. However, in step S21, each time interval of the plurality of time intervals may not be the same in length/duration. The step of dividing the plurality of driving waveforms to the plurality of time intervals may be implemented by dividing the plurality of driving waveforms at the change point of the voltage value for making the voltage value be constant in each time interval. Additionally, the unit time may be the greatest common divisor of the time intervals so that the time intervals may be multiple times of the unit time.

In other words, the longer the voltage values of each driving waveform remain unchanged, the less the number of the time intervals is. When the number of the time intervals becomes smaller, the corresponding volume of the voltage waveform record stored into the look-up table may be reduced accordingly. It is worth mentioning that, the method of dividing the driving waveforms to the plurality of time intervals described in step S21 is not restricted thereto.

Please refer to FIG. 1 again. Each of the four driving waveforms shown in FIG. 1 has thirty-four time intervals (1~34), and these thirty-four time intervals is depended on and generated according to the voltage changes of the four driving waveforms. However, when the requirement of display performance is less demanding and the numbers of colors for pixels to display is less, the display performance may not be degraded dramatically by fine tuning when the voltage values of the driving waveform change. Fine tuning when the voltage values change in the driving waveform may be combining voltage changes of driving waveforms in the neighboring time intervals into one time interval, or simplifying minor waveforms.

The waveforms in time intervals 25 and 26 are taken as an example to describe how to combine the voltage changes of driving waveforms in the neighboring time intervals into one time interval. Each of the driving waveforms of black to black, black to light gray, and black to white has one change to the voltage value in the time intervals 25 and 26 respectively, thus three voltage waveform records have to be stored in the look-up table traditionally. However, the changes to the voltage values of the mentioned three driving waveforms in the time intervals 25 and 26 can be fine-tuned to be at the same time interval, reducing the number of the time intervals stored in the look-up table.

The waveforms in time intervals 3 and 4 are taken as an example to describe how to simplify the minor waveforms. In the time intervals 3 and 4, the driving waveform of black to black is a shaking pulse, which is one example of the minor waveform, for reducing the inertness of microcapsules. Because the pixels represented by microcapsules may only display four gray levels, the shaking pulses can be reduced or the shaking pulses of the driving waveform in the time intervals 3 and 4 can be simplified or omitted. Therefore, the change to the voltage value of the shaking pulse of the driving waveform for black to black in the time intervals 3 and 4 can be manipulated to be at other time intervals. Similarly, number of changes to the voltage values of the driving waveform for black to black in the time intervals 14~19, 23~26, and 29~31 may be reduced too, wherein the changes to the voltage values during the time intervals 14~19, 23~26, and 29~31 include swings to the high voltage for three times and back to zero volt for three times. In other words, simplifying the minor waveforms may include reducing the minor waveforms, reducing changes to voltage values of the minor waveforms, or even neglecting the minor waveforms.

Please refer to FIG. 2 again. In step S22, the voltage waveform record consists of the number of the unit times for each time interval and the voltage values during the time intervals. The unit time meanwhile may stand for a shortest period of time during which the voltage value of the driving waveform remains the same, thus the voltage waveform records formed in step S22 can have a smaller data size. Additionally, fine tuning when the changes to the voltage values take place may reduce the number of the time intervals, thus further reducing the size of the voltage waveform records.

Figure 3:
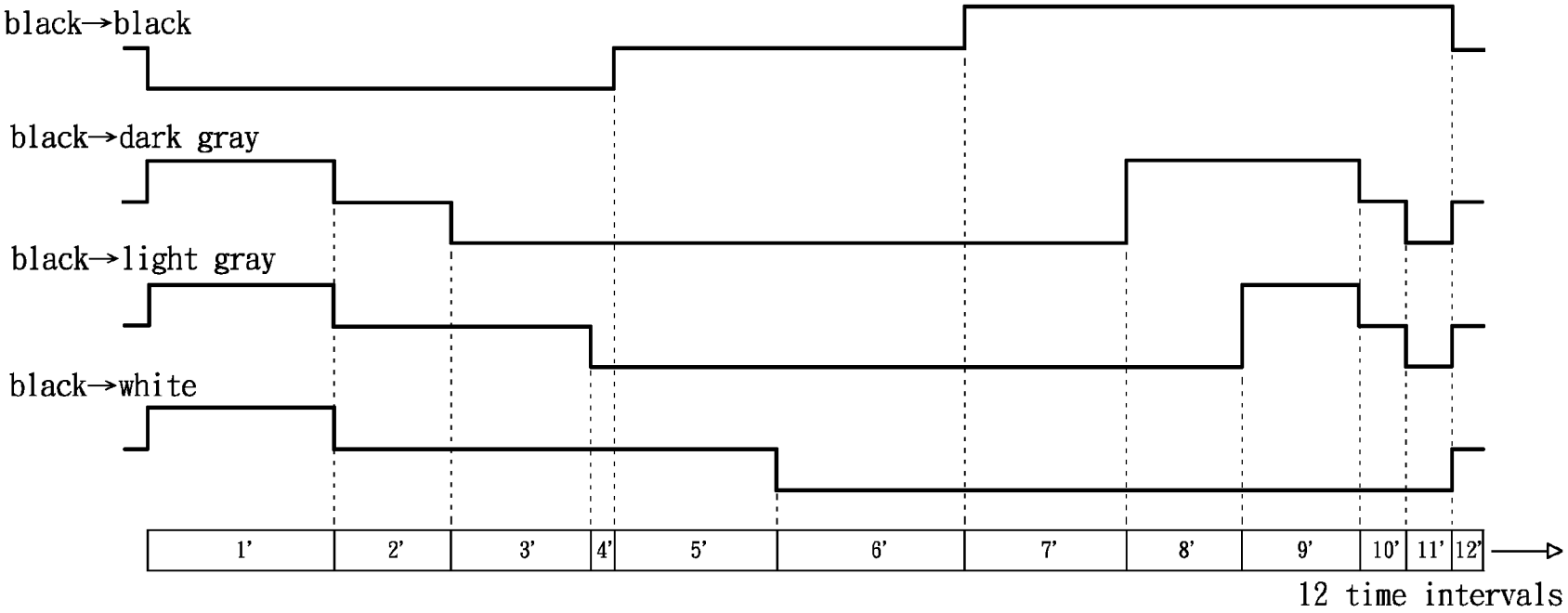
FIG. 3 shows a curve diagram of a method of driving waveforms stored in a look-up table of an electrophoretic display according to an embodiment of the instant disclosure.

Please refer to FIG. 3, FIG. 3 shows a waveform diagram of a method of driving waveforms stored in a look-up table of an electrophoretic display according to an embodiment of the instant disclosure. The driving waveforms shown in FIG. 3 also include four driving waveforms, namely black to black, black to dark gray, black to light gray, and black to white. The number of the time intervals of these waveforms shown in FIG. 3 could be reduced to 12 (time intervals 1'~12'). For example, the waveform of black to black shown in FIG. 3 can be maintained at a single voltage value in the time intervals 1'~4' by skipping the shaking pulse of the driving waveform of black to black at the time intervals 3 and 4 (shown in FIG. 1). Also shown in FIG. 3, the waveform of black to black is simplified by reducing the number of the changes to the voltage values in the time intervals 14~19, 23~26, and 29~31. Consequently, the changes to the voltage value of the driving waveform black to black may only occur at the time intervals 5'~6' (swing back to zero volt once) and time intervals 7'~11' (swing to the high voltage again).

Please refer to FIG. 3 again. Additionally, the time intervals 10'~11' and the time intervals 1'~2' shows the result of combining voltage changes of driving waveforms in the neighboring time intervals into one time interval. The changes to the voltage values of the driving waveforms for black to dark gray, black to light gray, and black to white occur during the time intervals 10'~11' and during the time intervals 1'~2'. The time intervals 10'~11' and time intervals 1'~2' may be combined for reducing the total numbers of time intervals.

Therefore, the voltage value of driving waveforms can be represented in two bits and be stored to the look-up table for the driving waveforms to make the display adopting be supportive of the display of four colors. In one implementation, the number of the unit times in the time interval may range between 10 and 20. As such, the number of the unit times in the time intervals may be represented in four bits, indicating each of the time intervals may not longer than 15 time units.

Please refer to FIG. 1 and FIG. 3, in step S23, the driving waveforms stored in the look-up table may be arranged sequentially in terms of the time frame. Comparing the complexity of waveforms shown in FIG. 1 and FIG. 3, the look-up table established by the method described in this embodiment may be smaller in size. Hence, the storing capacity of a memorizing module for storing the look-up table can be reduced. Furthermore, in order to store the look-up table, the memorizing module includes a one-time programmable (OTP) read only memory or a flash memory.

[An Embodiment Of An Electrophoretic Display Device]

Figure 4:
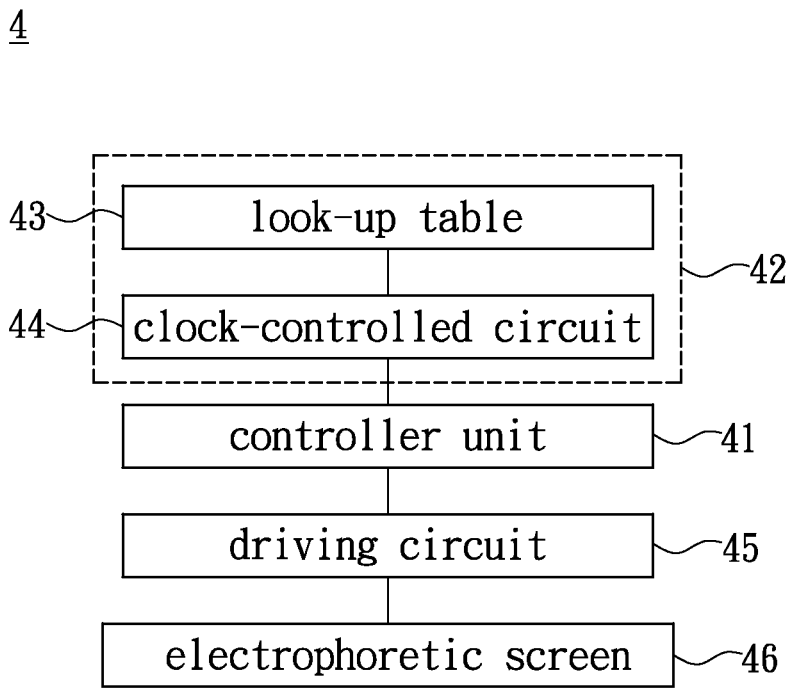
FIG. 4 shows a block diagram of an electrophoretic display according to an embodiment of the instant disclosure.

FIG. 4 shows a block diagram of an electrophoretic display according to an embodiment of the instant disclosure. The electrophoretic display device 4 includes a controller unit 41, a memorizing module 42, a driving circuit 45, and an electrophoretic screen 46. The driving circuit 45 is electrically coupled to the electrophoretic screen 46. The memorizing module 42 is electrically coupled to the driving circuit 45 through the controller unit 41. The memorizing module 42 includes a look-up table 43, and a clock-controlled circuit 44.

The controller unit 41 receives a plurality of driving waveforms provided by the memorizing module 42. The controller unit 41 transmits the plurality of driving waveform to the driving circuit 45. The driving circuit 45 drives the electrophoretic screen 46 according to the plurality of driving waveform. The driving waveforms are provided by a plurality of voltage waveform records stored in the look-up table 43. The clock-controlled circuit 44 of the memorizing module 42 extracts (or reads out) the plurality of voltage waveform records stored in the look-up table 43 in time sequence.

The look-up table 43 may be a one-time programmable read only memory or a flash memory. Each of the plurality of the driving waveforms may be divided to a plurality of time intervals, and the length of each of the time intervals is multiples of the unit time. The plurality of driving waveforms is divided at the change point of the voltage value changed over time for making the voltage value at each time interval be constant. The plurality of voltage waveform records is obtained according to the plurality of voltage values and the number of the unit times within the corresponding time intervals. The plurality of voltage waveform records is stored into the look-up table sequentially in terms of the time frame. The method to obtain the plurality of voltage waveform records can be referred to the previous embodiment, thus the redundant information is not repeated.

Please refer to FIG. 3 and FIG. 4, the voltage values of the driving waveform can be represented in terms of two-bit data before being stored to the look-up table 43. Therefore, the driving circuit 45 drives the electrophoretic display device 4 to display four colors (or gray levels). The numbers of unit time of the time intervals may between 10 and 20, such as 12 time intervals. The numbers of unit time of the time intervals may be represented in four bits, thus the time interval may be longest as to 15 unit times. For example, the unit time can be 20 millisecond (ms), and the time intervals can be 0~300 millisecond.

Please refer to FIG. 3 and FIG. 4 again. Generally, the driving waveform of the electrophoretic display device 4 may vary at different operation temperatures. For example, For 0~50 □, the operation temperature can be divided into 11 ranges of temperature. When the voltage value of each driving waveform is represented and stored in two bits and the number of the unit time of the time intervals are represented and stored in four bits, the driving waveform in each range of temperature occupies 90 bytes of data quantity, thus the driving waveform in all ranges of temperature (11 ranges of temperature) totally occupies about to 990 bytes of data quantity. Relatively, a traditional look-up table occupies about 64 Kbyte.

According to the mentioned embodiments, the method of establishing a look-up table for an electrophoretic display and device may effectively reduce the size of the voltage waveform records associated with the driving waveforms stored to the look-up table, which may be applicable to the electrophoretic displays that are smaller in size or less demanding in resolution. The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A method of establishing a look-up table for an electrophoretic display, for establishing a plurality of driving waveforms of the electrophoretic display to the look-up table, comprising:

dividing the plurality of driving waveforms to a plurality of time intervals according to a plurality of voltage values of the plurality of driving waveforms;

obtaining a plurality of voltage waveform records according to the plurality of voltage values and number of unit times of the corresponding time intervals;

storing the plurality of voltage waveform records into the look-up table, wherein each voltage waveform record includes the number of the unit times in each of the time intervals and the voltage values corresponding to each of the time intervals;

fine-tuning voltage changes of driving waveforms in the neighboring time intervals to be at the same time interval, so as to reduce the number of the time intervals stored in the look-up table; and combining a part of the time intervals having the same voltage value in each driving waveform, so as to reduce the number of the changes to the voltage values in each driving waveform and thus further reducing the number of the time intervals stored in the look-up table.

2. The method of establishing the look-up table for the electrophoretic display according to claim 1, wherein the method of dividing the plurality of driving waveforms to the plurality of time intervals includes dividing the plurality of driving waveforms at the change point of the voltage value for making the voltage value be constant in each time interval.

3. The method of establishing the look-up table for the electrophoretic display according to claim 1, wherein a length of each time interval is multiple times of the unit time.

4. The method of establishing the look-up table for the electrophoretic display according to claim 1, further comprising:

simplifying minor waveforms of the corresponding driving waveform by reducing the minor waveforms, reducing changes to voltage values of the minor waveforms, or neglecting the minor waveforms.

5. The method of establishing the look-up table for the electrophoretic display according to claim 4, wherein the minor waveforms comprise shaking pulses for reducing the inertness of microcapsules in the electrophoretic display, and wherein the step of simplifying comprises reducing the number of the shaking pulses or directly omitting the shaking pulses.

6. The method of establishing the look-up table for the electrophoretic display according to claim 1, wherein the voltage values of each driving waveform are represented in two bits and stored in the look-up table.

7. The method of establishing the look-up table for the electrophoretic display according to claim 6, wherein each of the time intervals has 10~20 unit times.

8. The method of establishing the look-up table for the electrophoretic display according to claim 6, wherein the number of the unit times in the time intervals are represented in four bits and stored in the look-up table for making the intervals not longer than 15 unit times.

9. An electrophoretic display device, comprising:

an electrophoretic screen;

a driving circuit, electrically coupled to the electrophoretic screen, driving the electrophoretic screen according to a plurality of driving waveforms; and a memorizing module, electrically coupled to the driving circuit, having a look-up table storing the plurality of driving waveforms for driving the electrophoretic screen;

wherein, each of the plurality of driving waveforms is divided to a plurality of time intervals, each of the plurality of driving waveforms is divided at the change point of the voltage value changed over time for making the voltage value at each of the time intervals remain substantially constant, a plurality of voltage waveform records are obtained according to the plurality of voltage values and number of unit times of the corresponding time intervals, and the voltage waveform records are stored into the look-up table, wherein each voltage waveform record comprises the number of the unit times in the time intervals and the voltage values corresponding to each of the time intervals;

wherein voltage changes of driving waveforms in the neighboring intervals are fine-tuned to be at the same time interval, so as to reduce the number of the time intervals stored in the look-up table, wherein a part of the time intervals having the same voltage value in each driving waveform are combined, so as to reduce the number of the changes to the voltage values in each driving waveform and thus further reducing the number of the time intervals stored in the look-up table.

10. The electrophoretic display device according to claim 9, wherein a length of each time interval is multiple times of the unit time.

11. The electrophoretic display device according to claim 9, wherein the memorizing module is a one time programmable read only memory or a flash memory.

12. The electrophoretic display device according to claim 9, wherein at least a corresponding one of the driving waveforms has minor waveforms, the minor waveforms comprise shaking pulses for reducing the inertness of microcapsules in the electrophoretic screen, and wherein the minor waveforms are simplified by reducing the number of the shaking pulses or directly omitting the shaking pulses.

* * * * *